United States Patent [19]

White, Jr.

[11] 4,033,827

[45] July 5, 1977

[54] APPARATUS FOR SEALING A COKING CHAMBER

[76] Inventor: Herbert A. White, Jr., 2516 Collins Road, Pittsburgh, Pa. 15235

[22] Filed: Feb. 2, 1976

[21] Appl. No.: 654,516

[52] U.S. Cl. ..... 202/248; 49/475; 110/173 R; 122/498; 202/269; 277/234

[51] Int. Cl.[2] ..... C10B 1/06; C10B 25/16

[58] Field of Search ..... 202/247, 248, 269, 242; 110/173, 174, 175; 277/233, 234; 49/475; 122/498

[56] References Cited

UNITED STATES PATENTS

| | | | |
|---|---|---|---|
| 665,931 | 1/1901 | Pratt | 277/233 X |
| 2,249,127 | 7/1941 | Goetze | 277/234 X |
| 2,668,075 | 2/1954 | Van Ackeren et al. | 202/248 X |
| 2,778,785 | 1/1957 | Otto | 202/248 |
| 3,149,615 | 9/1964 | Forsans | 122/498 |
| 3,881,995 | 5/1975 | White, Jr. | 202/269 X |

FOREIGN PATENTS OR APPLICATIONS

| | | | |
|---|---|---|---|
| 19,293 | 8/1895 | United Kingdom | 202/247 |

*Primary Examiner*—Barry S. Richman
*Assistant Examiner*—Michael S. Marcus
*Attorney, Agent, or Firm*—Martin J. Carroll

[57] ABSTRACT

Apparatus for providing a good seal between sealing edges and sealing surfaces of a coke oven door includes an improved high temperature resistant, compressible and deformable sealing member between the sealing edge and sealing surface. The sealing member includes a layer of high temperature resistant compressible insulating material between an outer layer of steel foil and a perforated steel strip. In one embodiment there is a second layer of insulating material between the perforated steel strip and a second outer layer of steel foil.

11 Claims, 8 Drawing Figures

APPARATUS FOR SEALING A COKING CHAMBER

This invention relates to apparatus for sealing a coking chamber or the like and particularly to an improvement on the apparatus shown in my prior U.S. Pat. No. 3,881,995 dated May 6, 1975. This apparatus includes a sealing member provided between the sealing edges and sealig surfaces of the coke oven door. While this sealing member has performed its intended purpose it has not been used universally because of its relatively short life. I have determined that at least one of the principal reasons for the short life is that the load transmitted through the sealing edge to the sealing member is not spread out by the sealing member, but is limited to approximately the width of the sealing edge which is normally about ⅛ inch. I have found that this load can be transmitted and spread over substantially the full width of the sealing surface of the door jamb by providing a perforated steel strip as one layer of the sealing member. This, in addition to providing a life more than twice as long as my prior sealing member, provides a much better seal because of the greater width of tight contact.

Another disadvantage of my prior seal is that it is rather fragile and is relatively difficult to handle and install.

It is therefore an object of my invention to provide a sealing member for use with coke oven doors which has substantially better life and gives a better seal than previous sealing members.

Another object is to provide such a sealing member which is easy to handle and install.

These and other objects will become more apparent when referring to the following specification and drawings, in which.

Figure 1:
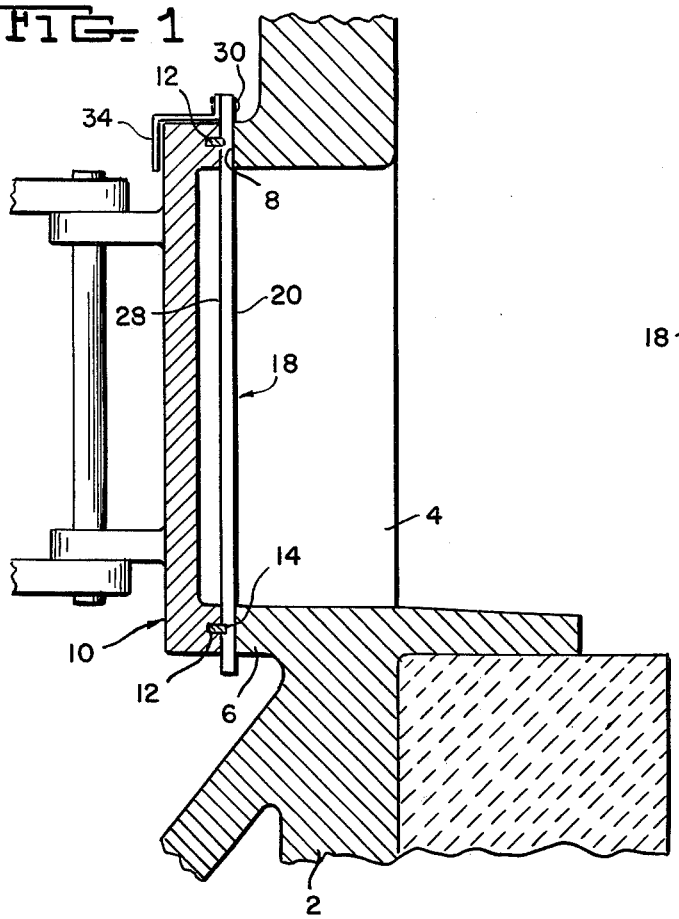
FIG. 1 is a sectional view of a leveler door in place in a coke oven and having my seal incorporated therein.
Figure 2:
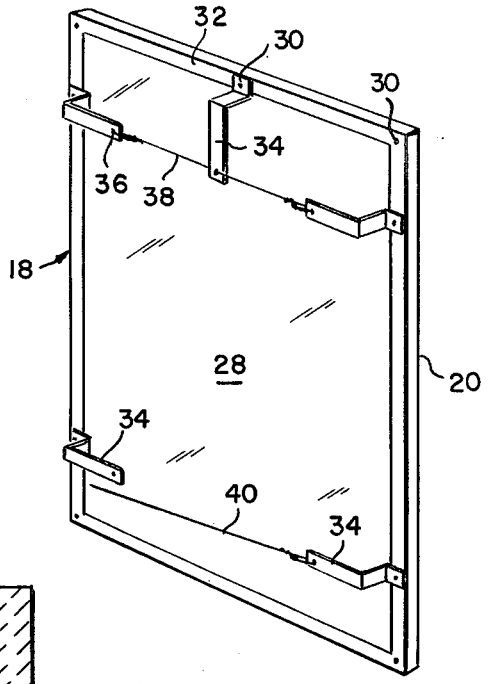
FIG. 2 is a perspective view of the seal of FIG. 1.
Figure 3:
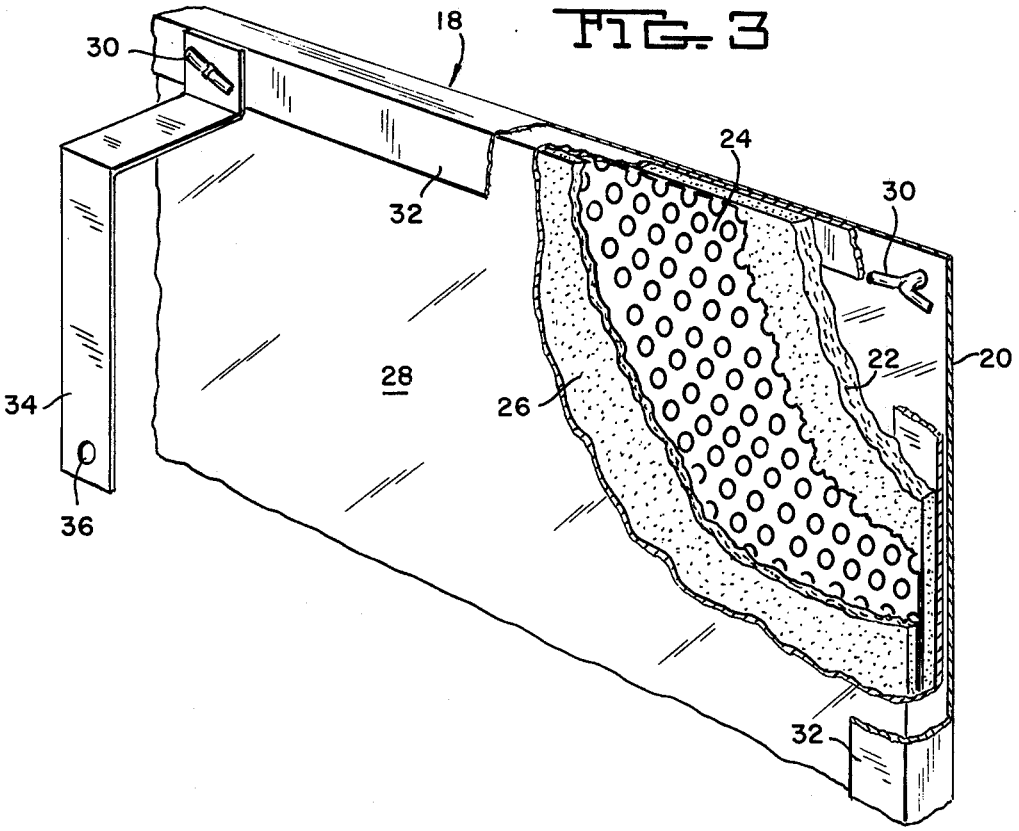
FIG. 3 is a perspective view of the seal with parts broken away.

Referring more particularly to FIGS. 1 to 3 of the drawings, reference numeral 2 indicates an oven door on the pusher side of a coking chamber of a coke oven. The door 2 has a door opening 4 therein surrounded by a door jamb 6 having a peripheral sealing surface 8 surrounding the door opening. A leveler door 10 is provided with a peripheral steel strip 12 forming a sealing edge 14 adapted to engage the sealing surface 8. The door 10 is moved into position with the edge 14 held against surface 8 such as by spring tensioning means, not shown. A high temperature resistant, deformable and compressible laminated sealing member 18 is positioned between the surface 8 and edge 14. While the member 18 may be formed by a number of separate strips I prefer that it be a single unit as shown. The apparatus and operation so far described are conventional except for details of the member 18.

According to my invention the sealing member 18 includes an outer layer 20 of steel foil, preferably made of stainless steel, such as stainless 310. A thickness of 0.02 inch has been found satisfactory, but it may be 0.04 inch thick. In some instances the layer 20 may be made of two thicknesses of foil. A layer of high temperature resistant compressible insulating material 22 is positioned against the layer 20. Asbestos paper ⅛ inch thick has been found acceptable. A perforated steel strip 24 is arranged adjacent layer 22. Mild carbon steel strip of 20 gauge (0.0368 inch) having 5/32 inch diameter holes on 3/16 inch centers has been found acceptable. A second layer of high temperature resistant compressible insulating material 26 is positioned adjacent layer 24. This is preferably asbestos paper of less thickness (such as 1/16 inch) than layer 22. An outer layer 28 is positioned adjacent layer 26. This is preferably 0.02 inch mild carbon steel foil. The layers of the member 18 are held together in any suitable manner, such as by means of split rivets 30 passing therethrough. As shown the outer layer 20 is bent over around the outside of the laminate with a flange 32 extending around the periphery of and bearing against the outside of layer 28 and the outer layer 28 is bent over inside the layer 20 and then inwardly around its periphery and bearing against the inside surface of layer 20. This provides a very secure assembly of the parts.

For attachment purposes, several bent steel strips 34 may be secured to the cold or outer side of sealing member 18 by means of the rivets 30. As shown, two strips are provided along each longitudinal side and one at one end. A hole 36 is provided in the outer part of each strip 34.

In operation, the member 18 is placed against the door 10 with the bent strips 34 extending around the sides of the door and bearing against its cold face. A steel wire 38 passes through hole 36 of the end strip 34 with its ends connected in the holes 36 of the upper pair of side strips 34. A similar steel wire 40 connects the lower pair of side strips 34. After the coal is leveled in the usual manner the door 10 with sealing member 18 attached is positioned in the usual manner against the door jamb. Because the member 18 is deformable and compressible it will form a good seal regardless of slight irregularities in the sealing surface or sealing edge. The ⅛ inch layer of asbestos takes up most of the compression while the thinner layer serves mostly to keep the layers apart. In addition to the advantages of the sealing member of my prior patent, the present laminated sealing member has the ability to make contact across substantially the full width of the sealing surface 8 which of course gives a better seal and also gives longer life to the seal. The cost of the sealing member per ton of coke is less than half of that of my previous seal. The use of stainless steel on the hot face also results in greater life than when using mild steel. While the materials described are particularly advantageous it will be understood that some of the advantages of my sealing member will be obtained by using other materials of less durability.

Figures 4, 5, 6, 7, 8:
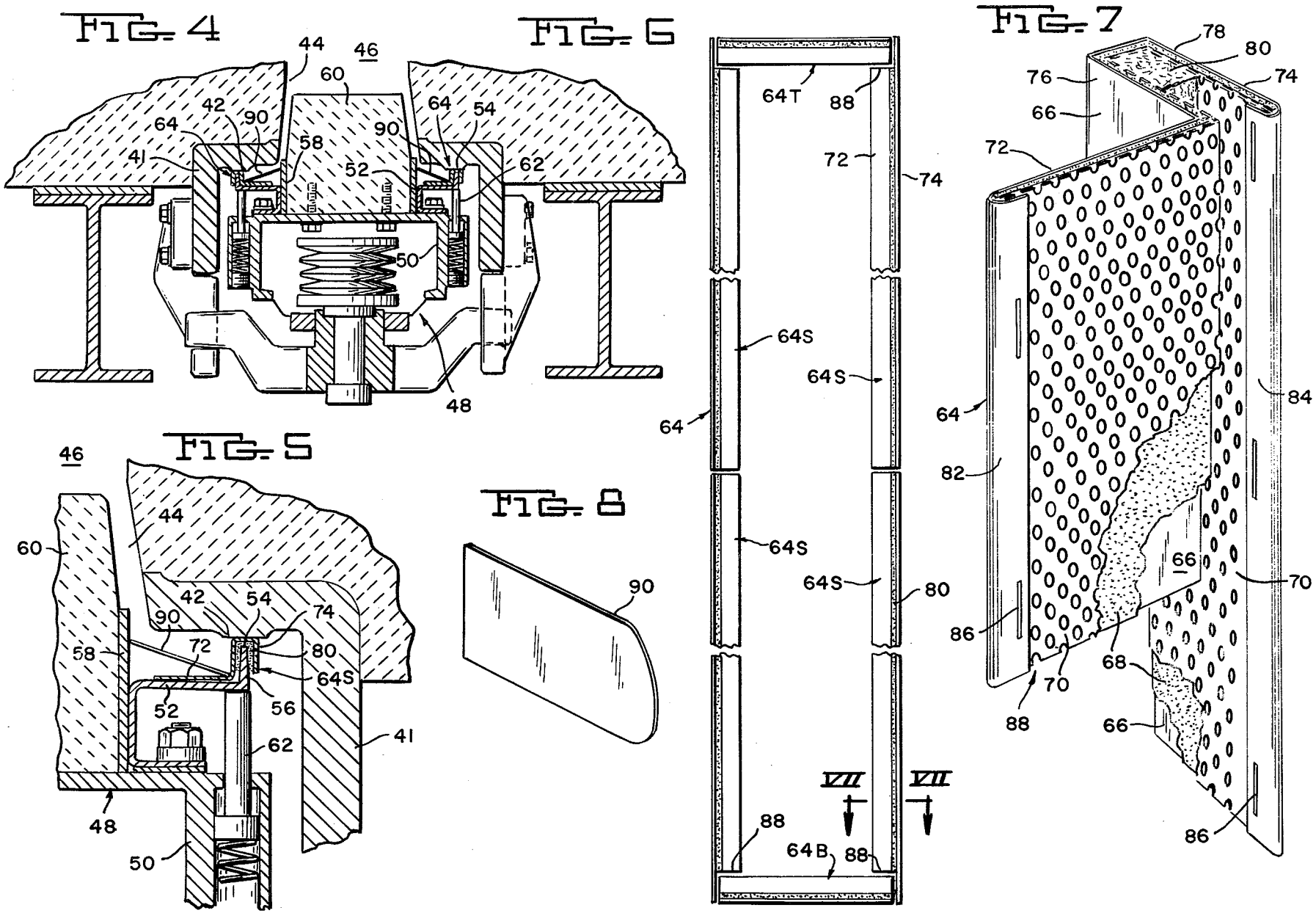
FIG. 4 is a sectional view of a main coke oven door utilizing my improved seal in place on a coke oven.
FIG. 5 is an enlarged sectional view of a portion of FIG. 4.
FIG. 6 is a schematic view showing how sections of the seal are arranged around the periphery of the door.
FIG. 7 is a view taken on the line VII-VII of FIG. 6.
FIG. 8 is a perspective view of attachment means.

FIGS. 4 to 8 disclose a main coke oven door which requires a modified type of sealing member. As best shown in FIGS. 4 and 5 a door jamb 41 having a flat peripheral sealing surface 42 surrounds door opening 44 into coking chamber 46. Door 48 includes a metal frame 50 having a peripheral bent steel plate or sealing ring 52 fastened thereto. The plate 52 has a sealing edge 54 formed at the inner end of an outwardly extending surface 56. Also fastened to frame 50 are inwardly extending metal flanges 58 for receiving a refractory plug 60 which extends into the door opening 44 beyond sealing surface 42. Spring pressed plungers 62 mounted on frame 50 in spaced apart relationship about its periphery bias the sealing edge 54 into engagement with sealing surface 42. This construction and other parts of the coke oven and door shown as well as the door handling apparatus are conventional.

According to my invention I provide a laminated sealing member 64 which is positioned between the sealing surface and sealing edge. In this embodiment the laminated sealing member 64 includes an outer steel foil layer 66, a high temperature resistant compressible insulating layer 68 adjacent layer 66, and a perforated steel strip 70 adjacent the layer 68. The layer 70 is preferably of the same material and construction as strip 24. The layer 66 is preferably mild carbon steel and the layer 68 a combination of alumina and silica such as FIBRE FRAX paper although the layers 66 and 68 may be of the same materials as in the first embodiment.

If desired, a second outer layer of steel foil may be positioned adjacent the perforated layer. For use with doors similar to the first embodiment, but in less severe conditions, this member may be used flat as in the first embodiment. However, when used with the coke oven door, the member 64 is L-shaped with one flat leg 72 and one U-shaped leg 74 having spaced apart sides 76 and 78 with a CERRA blanket (alumina silica) 80 positioned between the sides 76 and 78 at the base of the U-shaped leg 74. Other forms of compressible insulating material may be used in place of the CERRA blanket. In manufacture, the layers 66 and 70 are bent into the same L-shape as the sealing member and the layers are assembled with the insulating layer 68 therebetween. The longitudinal edges of the layer 66 are then bent around the other layers with flanges 82 and 84 bearing against layer 70 so that the sealing member can be held assembled by fasteners 86 passing from the main portion of layer 68 to the outside of flanges 82 and 84. In one particular embodiment leg 72 is 1½ inches wide, side 76 is 1 inch wide, and side 78 is 1½ inches wide with the sides 76 and 78 being spaced apart ½ inch. The layer 66 is 0.02 inches thick, the layer 68 is 1/16 inch asbestos paper, the layer 70 is 20 gauge, and the insulation 80 is ½ inch thick.

The sealing member 64 is preferably made in several pieces for ease of manufacture and assembly. As shown in FIG. 6 there is one top piece 64T, one bottom piece 64B and two side pieces 64S along each side. The leg 72 on each sidepiece 64S is terminated short of its end 88 adjacent the top or bottom piece to provide a better seal.

In operation, the pieces of member 64 are placed in position over the plate 52 with the sealing edge 54 embedded in insulation 80. Holding cleats 90 are then placed in spaced apart relationship about the door periphery with one end bearing against the adjacent flange 58 and the other end against the seal at the junction of leg 72 and side 76. The holding cleat 90 is preferably made of 20 gauge full hard mild carbon steel. The door 48 is then positioned in the usual manner against the door jamb with the sealing edge 54 being forced further into insulation 80. As in the first embodiment a seal is provided for substantially the full width of the sealing surface 42.

I have found that the temperature of the sealing member runs so high in use that tar does not condense on it. This eliminates the need for cleaning and fouling of the door by tar.

While several embodiments of my invention have been shown and described, other adaptations and modifications may be made without departing from the scope of the following claims.

I claim:

1. In a coke oven having a heating chamber, a door opening at one end of said chamber, a door jamb surrounding the door opening and having a flat sealing surface extending over its periphery, a door having a peripheral sealing edge at the end of a metal member generally normal to said sealing surface and adapted to engage said contacting sealing surface, and a detachable high temperature resistant, deformable and compressible sealing member adapted to be received between said sealing surface and said sealing edge, said sealing member including a plurality of layers one of which being a high temperature resistant compressible insulating material; the improvement wherein said sealing member includes an outer layer of steel foil adjacent one side of said layer of high temperature resistant compressible insulating material, and perforated steel strip means adjacent the other side of said layer of insulating material for spreading and equalizing the compressive load transmitted through the sealing edge to the sealing member.

2. The combination of claim 1 in which said outer layer of steel foil is selected from the group consisting of mild carbon steel and stainless steel, and said insulating material is selected from the group consisting of asbestos and a combination of alumina and silica.

3. The combination of claim 1 in which said insulating material is a combination of alumina and silica.

4. The combination of claim 1 including a second layer of high temperature resistant compressible insulating material adjacent the perforated steel strip on the side opposite said first layer of insulating material, and a second outer layer of steel foil adjacent said second layer of insulating material.

5. The combination of claim 4 in which said first outer layer of steel foil is stainless steel and said second outer layer of steel foil is mild carbon steel.

6. The combination of claim 5 in which said insulating material is asbestos.

7. The combination of claim 6 in which said first layer of insulating material is thicker than said second layer.

8. The combination of claim 1 in which said outer layer of steel foil is mild carbon steel, and said perforated steel strip is made of mild carbon steel and forms a second outer layer.

9. The combination of claim 8 in which said door includes a refractory plug extending into said chamber and said metal member extends outwardly from said sealing edge, said deformable sealing member includes a U-shaped leg receiving said metal member with the base of said U-shaped member spaced from said sealing edge, and compressible insulating material in said space.

10. The combination of claim 9 in which said door includes a flat metal surface extending from the base of said metal member toward said plug, and said deformable sealing member includes a flat leg extending from the outer end of one side of said U-shaped leg along said flat metal surface.

11. The combination of claim 10 in which said door includes a metal surface adjacent said plug arranged parallel to said metal member, and a metal holding cleat extends from the junction of said flat leg and U-shaped leg of said sealing member to said last named metal surface.

* * * * *